United States Patent [19]

Morton

[11] 3,963,916

[45] June 15, 1976

[54] BULBHOLDER

[75] Inventor: Kenneth Leonard Morton, Market Harborough, England

[73] Assignee: British Sealed Beams Limited, Corby, England

[22] Filed: Nov. 20, 1974

[21] Appl. No.: 525,454

[30] Foreign Application Priority Data

Jan. 16, 1974 United Kingdom ..... 2074/74

[52] U.S. Cl. ..... 240/52 R; 240/41 BM; 240/153; 339/144 T

[51] Int. Cl.[2] ..... F21V 21/00

[58] Field of Search ..... 240/41 BM, 41 SC, 41 L, 240/44.2, 153, 52 R, 151, 152; 339/119 L, 144 R, 144 T, 145 R, 145 T; 313/113, 318; 248/27

[56] References Cited

UNITED STATES PATENTS

| | | | |
|---|---|---|---|
| 1,669,659 | 5/1928 | Godley | 240/44.2 |
| 2,261,508 | 11/1941 | Trippe | 240/41 BM |
| 3,739,168 | 6/1973 | Ploeger | 240/153 X |
| 3,848,120 | 11/1974 | Wolfe et al. | 240/41 BM |
| 3,904,909 | 9/1975 | Vause | 313/318 |
| 3,909,607 | 9/1975 | Vause et al. | 240/41 BM |

FOREIGN PATENTS OR APPLICATIONS

| | | | |
|---|---|---|---|
| 1,209,463 | 10/1970 | United Kingdom | 240/153 |

*Primary Examiner*—Fred L. Braun
*Attorney, Agent, or Firm*—Finnegan, Henderson, Farabow & Garrett

[57] ABSTRACT

A bulbholder which is intended for accurately positioning a filament of a bulb, particularly a quartz halogen bulb, relative to a lamp reflector comprises a sheet metal body which receives a base of the bulb. A plurality of deformable legs in the form of loops serve to connect the body with a pair of flanges on opposite sides of the body. The flanges are fixed to a support and accurate positioning of the bulb filament is effected by moving the body relative to the flanges as permitted by deformation of the legs.

In one embodiment, the flanges are apertured and are rivetted to a ceramic support. In another embodiment, the flanges have arcuate lipped edges which are brazed to an annular surface on the support.

6 Claims, 8 Drawing Figures

BULBHOLDER

This invention relates to a bulbholder and is particularly, though not exclusively, concerned with a bulbholder for retaining a quartz halogen bulb accurately in position with respect to a lamp reflector.

It is an object of the present invention to provide an improved form of bulbholder which facilitates accurate setting of the bulb filament with respect to a lamp reflector.

According to the present invention, there is provided a bulbholder comprising a body adapted to receive the base of a bulb, at least one flange for mounting the holder on a support, and a plurality of deformable legs connecting the flange with the body, whereby the position of the body relative to the flange can be adjusted for bulb filament orientation purposes by deformation of the legs.

Conveniently, the flange extends laterally of the body and the legs are in the form of loops whereby the position of the body relative to the flange can be adjusted axially and angularly by appropriate deformation of the loops.

Preferably, the or each flange is formed integrally with the legs.

Conveniently, the bulbholder is intended for a bulb of the type which has at least one lead wire extending therefrom and is provided with a projection at an end thereof opposite to that into which the bulb base is inserted in use, over which projection the lead wire or one of the lead wires is passed to hold the bulb, in use, against disengagement from the body.

In one embodiment, the flange has a surface extending transversely with respect to the body, said surface being engaged, in use, against a surface of said support and secured thereto by securing means, for example, rivets.

In another embodiment, the flange has an arcuate, lipped edge remote from said legs, and the flange is disposed, in use, with the arcuate lipped edge engaging an annular surface of said support.

Embodiments of the present invention will now be described, by way of example, with reference to the accompanying drawings, in which.

Figure 1:
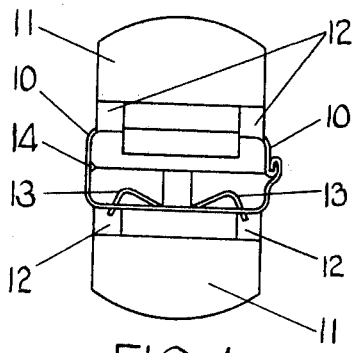
FIG. 1 is a plan view of a bulbholder according to the present invention.
Figure 2:
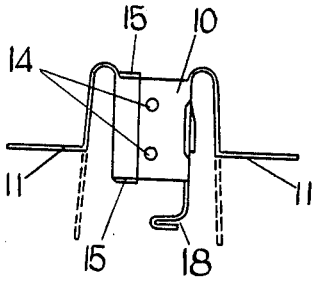
FIG. 2 is a side elevation of the bulbholder of FIG. 1.
Figure 3:
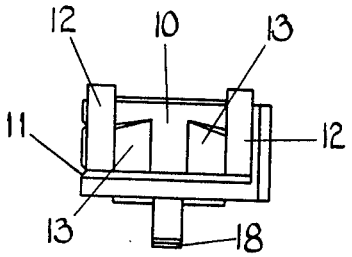
FIG. 3 is another side elevation of the bulbholder of FIG. 1.

Referring to FIGS. 1 to 3 of the drawings, the bulbholder comprises a fabricated sheet metal body 10 which is generally rectangular in plan view, a pair of flanges 11 extending laterally of the body and being disposed between the ends thereof, and a pair of laterally spaced legs 12 connecting each flange 11 with the body 10. Each leg 12 is in the form of a loop which extends integrally from the respective flange 11 and is secured to the body at its end remote from flange 11.

Figure 4:
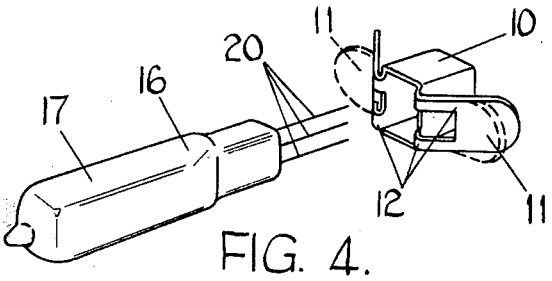
FIGS. 4 to 7 show schematically various stages in the mounting of a bulbholder according to the present invention, and bulb, onto a support.

Formed integrally on the body are a pair of clips 13, a pair of dimple projections 14, and a pair of lips 15. The clips 13 extend inwardly, are laterally spaced apart and disposed intermediate the ends of the body. The dimple projections 14 are spaced apart axially of the body. The lips 15 are inwardly directed and formed at opposite ends of the body 10. The clips 13, projections 14 and lips 15 are provided in the body 10 for engagement with recesses and projections (not shown) on the base 16 (FIG. 4) of a quartz halogen bulb 17. The bulb 17, when engaged with the body 10, is held firmly in position. It will be appreciated that the arrangement of clips 13, projections 14 and lips 15 ensure that the bulb 17 can only be engaged with the body 10 in one orientation thereof.

Also secured to the body 10 at the opposite end thereof from which the bulb 17 extends in use is a cranked projection 18 whose purpose will be described hereinafter.

Figure 5:
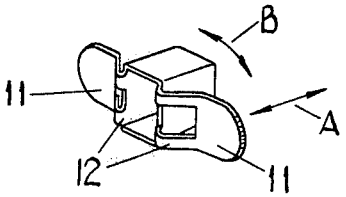
Figure 7:
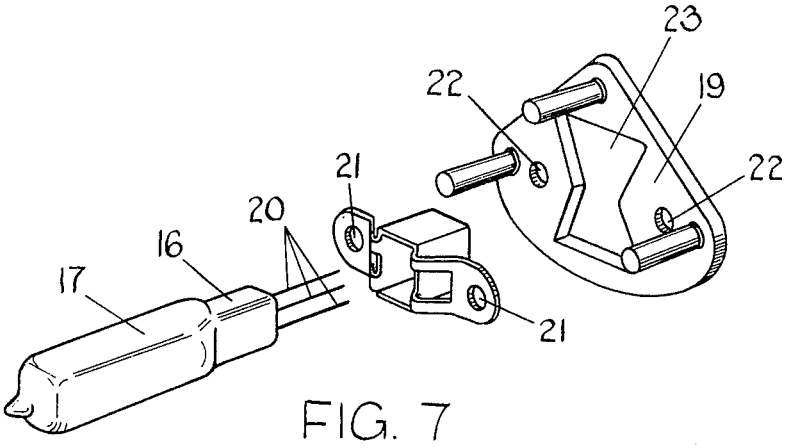

In order to mount the bulb 17 correctly with respect to a reflector it is necessary to ensure that the filament (not shown) thereof is correctly positioned with respect to the focal point of the reflector. This is effected by mounting the holder onto a ceramic support plate 19 (FIG. 7) which is ultimately accurately positioned behind a lamp reflector so that the bulb 17 can project through an aperture in the back of the reflector. However, during manufacture of the bulb 17, it is not possible to mount the filament consistently at exactly the same position with respect to the base 16. Accordingly, it is necessary to adjust the position of the bulbholder relative to the ceramic support plate 19 before fixing it in position thereon. In order to effect this with the bulbholder as described above, the base 16 of the bulb 17 is inserted into the body 10 so that three leads 20 thereon project through an end of the body 10 from which projection 18 extends. Then, the assembly of bulbholder 10 and bulb 17 is inserted into a setting jig so that the flanges 11 are held against a surface corresponding to the surface of plate 19 against which they are to be ultimately engaged. The actual position of the filament is then compared relative to a datum position at which the filament is desired to be held. If the filament lies ahead of or behind the desired, datum position, the body 10 is moved axially relative to the flanges 11 by appropriate deformation of legs 12 until the filament lies at the desired axial position. Following this, the axial alignment of the filament is set relative to the datum position by twisting the body 10 relative to the flanges 11 whilst keeping its fore and aft axial position constant relative to flanges 11. These two operations are illustrated schematically by respective arrows A and B in FIG. 5. For convenience, the bulb 17 is not shown in FIG. 5.

Figure 6:
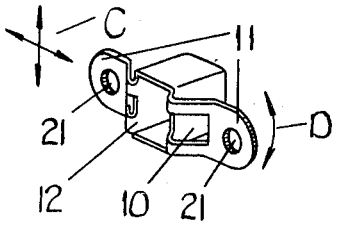

After this operation, the bulb and bulbholder are adjusted by up and down movement and angular movement (see arrows C and D respectively, FIG. 6) in a plane in which lie the flanges 11 this manipulation of bulb 17 and bulbholder is effected so as to bring the axis of the filament onto the desired axis and to ensure correct angular orientation of the filament relative to the axis. When the filament lies exactly in the desired position, holes 21 are punched into the flanges 11 by means of a piercing till (not shown) which is accurately located relative to the surface against which the flanges 11 are engaged.

Finally, the assembly of bulbs 17 and bulbholder is installed onto support plate 19 (see FIG. 7) so that the holes 21 are aligned with holes 22 in the plate 19. The bulbholder is then fixed to the plate 19 by means of eyelets (not shown) engaging holes 21 and 22. The body 10 of the bulbholder is disposed within a window 23. Lastly, the leads 20 are soldered onto terminals (not shown) on the opposite side of plate 19 to that from which bulb 17 projects. The arrangement is such that one of the leads 20 is passed over projection 18 and, after soldering, prevents subsequent disengagement of the bulbs 17 from the bulbholder and support plate 19.

Finally, the support plate carrying the bulbholder and bulb 17 is positioned in a lamp unit in a manner known per se.

The above described bulbholder permits the filament of the bulb 17 to be very accurately positioned with the result that a lamp unit fitted with such a bulbholder can operate with optimum efficiency.

Figure 8:
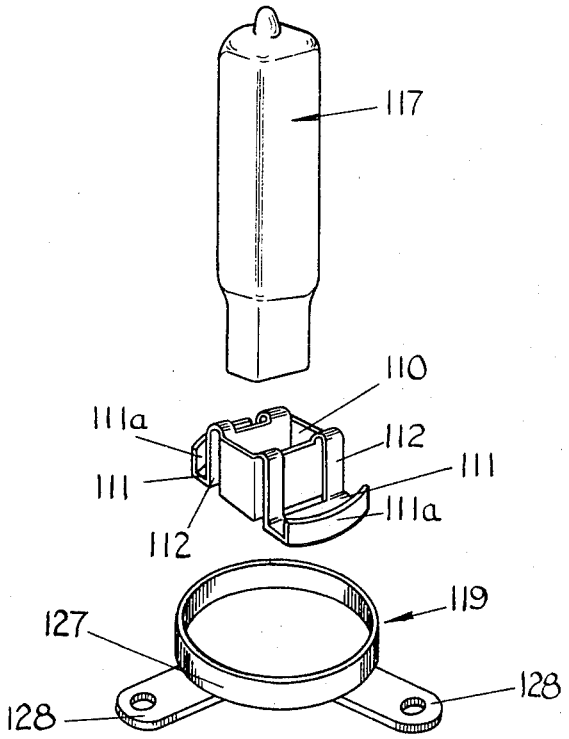
FIG. 8 is an exploded view of another form of bulbholder according to the present invention together with bulb and associated support.

Referring now to FIG. 8, the bulbholder illustrated therein is similar to the bulbholder of FIGS. 1 to 7 and similar parts are accorded the same reference numeral prefixed by the numeral "1". However in this embodiment, each flange 111 is provided with an arcuate lipped edge 111*a* remote from legs 112. The bulbholder is intended to be used with a support 119 formed of metal. The support 119 comprises an annulus 127 provided with apertured legs 128 to enable annulus 127 to be mounted, by means of a rivetting operation, into the base of a lamp reflector (not shown). The bulbholder is received in the annulus 127 with the lipped edges 111*a* of the flange 111 enaging the internal surface of annulus 127.

In use, the bulb 117 is engaged with the body 110 of the bulbholder in the manner described with reference to the bulbholder of FIGS. 1 to 7. Thus, the bulbholder and bulb assembly is engaged with the support 119 which has been previously accurately mounted in a setting jig so that the lipped edges 111*a* engage against the internal surface of annulus 127. The bulbholder is then manipulated by axial and/or angular movement relative to annulus 127 until the filament is in approximately the correct position. At this stage, the lipped edges 111*a* are secured to the annulus 127 by brazing.

Lastly, the precise positioning of the filament is obtained by movement of body 110 relative to flanges 111 as permitted by deformable legs 112 in a similar manner to the embodiment of FIGS. 1 to 7.

I claim:

1. A bulbholder comprising a body adapted to receive a base of a bulb, at least one flange for mounting said body on a support, and a plurality of deformable legs connecting said flange with said body, said legs serving to support said body on said flange and being deformable to enable said body to be adjusted in more than one direction relative to said flange for bulb filament orientation purposes, and said legs holding said body in the required position relative to said flange after deformation of said legs.

2. The bulbholder according to claim 1, wherein said flange extends laterally of said body and said legs are in the form of loops whereby the position of said body relative to said flange can be adjusted axially and angularly by appropriate deformation of said loops.

3. The bulbholder according to claim 1, wherein said flange is formed integrally with said legs.

4. The bulbholder according to claim 1, further comprising a projection at the end of said body opposite that into which the bulb base is inserted, said projection being adapted to engage a lead wire extending from the base of the bulb to hold said bulb against disengagement from said body.

5. The bulbholder according to claim 1, wherein said flange has a surface extending transversely with respect to said body, said surface being engaged, in use, against a surface of said support and secured thereto by securing means.

6. The bulbholder according to claim 1, wherein said flange has an arcuate, lipped edge remote from said legs, and said flange is disposed, in use, with said arcuate lipped edge engaging an annular surface of said support.

* * * * *